US009046334B1

(12) United States Patent
Redding

(10) Patent No.: US 9,046,334 B1
(45) Date of Patent: Jun. 2, 2015

(54) NON-LETHAL OBSCURATION GRENADE

(71) Applicant: U.S. Army Edgewood Chemical and Biological Command, APG, MD (US)

(72) Inventor: David R. Redding, Jarrettsville, MD (US)

(73) Assignee: The United States of America As Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/087,559

(22) Filed: Nov. 22, 2013

Related U.S. Application Data

(60) Provisional application No. 61/787,583, filed on Mar. 15, 2013.

(51) Int. Cl.
*F42C 14/02* (2006.01)
*F42C 19/095* (2006.01)
*F42B 27/00* (2006.01)

(52) U.S. Cl.
CPC ..... *F42C 19/095* (2013.01); *F42B 27/00* (2013.01)

(58) Field of Classification Search
CPC ..... F42C 19/02; F42C 19/095; F42C 14/02; F42B 12/46
USPC ..... 102/482, 498, 487, 367, 364, 357, 102/202.13, 368
See application file for complete search history.

(56) References Cited

U.S. PATENT DOCUMENTS

| | | | | | |
|---|---|---|---|---|---|
| 1,878,491 | A * | 9/1932 | Goss | 102/368 |
| 2,069,221 | A * | 2/1937 | Coupland | 102/487 |
| 2,101,071 | A * | 12/1937 | King | 102/487 |
| 3,112,703 | A * | 12/1963 | Urdapilleta | 102/487 |
| 3,380,383 | A * | 4/1968 | Schnepfe | 102/368 |
| 3,434,421 | A * | 3/1969 | Berlin et al. | 102/487 |
| 3,795,197 | A * | 3/1974 | Levenson | 102/368 |
| 4,947,753 | A * | 8/1990 | Nixon, III | 102/487 |
| 5,824,945 | A * | 10/1998 | Barlog et al. | 102/482 |
| 6,595,139 | B1 * | 7/2003 | Haeselich | 102/498 |
| 6,792,868 | B2 * | 9/2004 | Teilhol et al. | 102/487 |
| 8,161,883 | B1 * | 4/2012 | Harasts et al. | 102/482 |
| 8,661,979 | B2 * | 3/2014 | Veksler | 102/256 |
| 2010/0224092 | A1 * | 9/2010 | Kapeles et al. | 102/368 |
| 2010/0294157 | A1 * | 11/2010 | Dindl et al. | 102/334 |
| 2013/0186295 | A1 * | 7/2013 | Kravel | 102/487 |

* cited by examiner

*Primary Examiner* — Samir Abdosh
*Assistant Examiner* — John D Cooper
(74) *Attorney, Agent, or Firm* — Ulysses John Biffoni

(57) ABSTRACT

An incendiary device such as a grenade includes a fuze; a fuze bushing operatively connected to the fuze; a first plate snap fit to the fuze bushing; a delay column pressed into the first plate; a drag adapter partially surrounding the fuze bushing and contacting a top of the first plate; a burster tube operatively connected to the first plate; a second plate operatively connected to the burster tube; and a housing body screw fit to the first plate and the second plate and surrounding the burster tube, wherein the first plate and the second plate are epoxied to the housing body and the burster tube, wherein the fuze is configured to initiate causing gases and sparks to be released between the fuze bushing and the first plate, wherein the gases and sparks increases a pressure causing the fuze and the fuze bushing to be ejected from the housing body.

19 Claims, 3 Drawing Sheets

NON-LETHAL OBSCURATION GRENADE

CROSS-REFERENCE TO RELATED APPLICATIONS

This application claims the benefit of U.S. Provisional Application No. 61/787,583, filed on Mar. 15, 2013, the complete disclosure of which, in its entirety, is hereby incorporated by reference.

GOVERNMENT INTEREST

The invention described herein may be manufactured, used, and/or licensed by or for the United States Government.

BACKGROUND

1. Technical Field

The embodiments herein generally relate to incendiary devices, and more particularly to grenades.

2. Description of the Related Art

The M-106 grenade is a U.S. Army non-lethal obscuration grenade intended to be used in close proximity to friendly forces. The obscuration payload is titanium dioxide that is dispersed by exploding KAP (potassium perchlorate, aluminum, pentaerythritol) mixture contained in a central burster. The conventional design consists of a top and bottom plate that is held approximately four inches apart by four screws. The purpose of these screws is to prevent the top and bottom plates from being propelled when the grenade bursts and possibly causing injury when the grenade functions. The top plate is threaded to accept an M-201 fuze. While the bolts work well to prevent hazards associated with the end plates, the fuze has a unique set of problems.

The M-201 fuze was designed to be used on obscuration grenades that exhibit slow lower pressure burning characteristics. The M-201 fuze body is constructed of cast zinc and was not designed to withstand the higher pressure present during the functioning of the M-106. In past testing the fuze body has fractured creating a potentially lethal fragmentation hazard. Accordingly, it is desirable to reduce the fragmentation hazard associated with the M-106 grenade.

SUMMARY

In view of the foregoing, an embodiment herein provides a grenade comprising a fuze; a fuze bushing operatively connected to the fuze; a first plate operatively connected to the fuze bushing; an adapter partially surrounding the fuze bushing and adjacent to the first plate; a burster tube operatively connected to the first plate; a second plate operatively connected to the burster tube; and a housing body operatively connected to the first plate and the second plate and housing the burster tube. The fuze is configured to initiate causing gases and sparks to be released between the fuze bushing and the first plate, wherein the gases and sparks increases pressure causing the fuze and the fuze bushing to be ejected from the housing body. The adapter dissipates kinetic energy upon the fuze and the fuze bushing being ejected from the housing body. The grenade further comprises a delay column pressed into the first plate, wherein the gases and sparks ignite the delay column. The delay column activates a primer after a predetermined delay, wherein the primer initiates the burster tube. The predetermined delay is approximately one second. The predetermined delay permits the fuze to travel sufficiently far enough from the housing body so that the fuze is not accelerated by the burster tube. The first plate and the second plate are epoxied to the housing body and the burster tube.

Another embodiment provides an incendiary device comprising a fuze; a fuze bushing operatively connected to the fuze; a first plate snap fit to the fuze bushing; a delay column pressed into the first plate; an adapter partially surrounding the fuze bushing and contacting a top of the first plate; a burster tube operatively connected to the first plate; a second plate operatively connected to the burster tube; and a housing body screw fit to the first plate and the second plate and surrounding the burster tube, wherein the first plate and the second plate are epoxied to the housing body and the burster tube, wherein the fuze is configured to initiate causing gases and sparks to be released between the fuze bushing and the first plate, wherein the gases and sparks increases a pressure causing the fuze and the fuze bushing to be ejected from the housing body, wherein the adapter dissipates kinetic energy upon the fuze and the fuze bushing being ejected from the housing body, wherein the gases and sparks ignite the delay column, wherein the delay column activates a primer after a predetermined delay of approximately one second, wherein the primer initiates the burster tube, and wherein the predetermined delay permits the fuze to travel sufficiently far enough from the housing body so that the fuze is not accelerated by the burster tube.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1B:
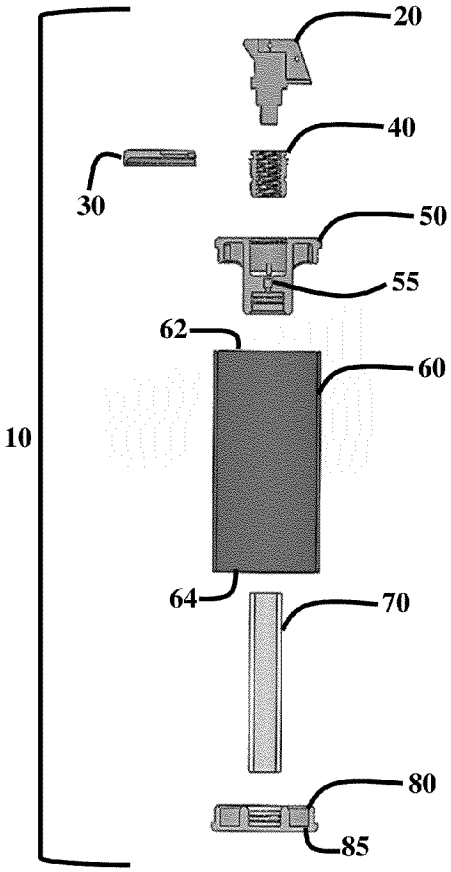
FIG. 1B illustrates a front exploded sectional view of a grenade of FIG. 1A according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a technique to simplify production and reduce the fragmentation hazard associated with the M-201 fuze on the M-106 grenade. Referring now to the drawings, and more particularly to FIGS. 1A through 6, where similar reference characters denote corresponding features consistently throughout the figures, there are shown preferred embodiments.

The technique provided by the embodiments herein for reducing the hazards associated with fuze fragments involves ejecting the fuze 20 before the burster tube 70 functions. This is generally accomplished by adding a fuze bushing 40 that snaps into the top plate 50 of the grenade 10. More particularly, as shown in FIGS. 1A through 2, the grenade 10 comprises a fuze 20 that is connected (e.g., screw connection, etc.) to a fuse bushing 40. The fuse bushing 40 connects (e.g., snap connection, etc.) to a top plate 50. A drag adapter 30 partially surrounds the fuse bushing 40 and is positioned adjacent to the top plate 50. The top plate 50 further includes a delay column 55 configured inside the top plate 50. The top plate 50 is connected to the top 62 of a grenade body 60, which further houses a central burster tube 70. A bottom plate 80 connects to the burster tube 70 and bottom 64 of the grenade body 60.

The embodiments herein include a keyway to allow the fuze 20 to be screwed in and out, an o-ring groove (e.g., drag adapter 30) to protect the energetic materials from the environment, and a snap-in feature (e.g., fuse bushing 40) to retain the fuze 20 prior to functioning. The dimensions and configurations of the snap-in feature (e.g., fuse bushing 40) can be modified to change the amount of force necessary to allow separation of the fuze bushing 40 from the top plate 50.

Figure 1A:
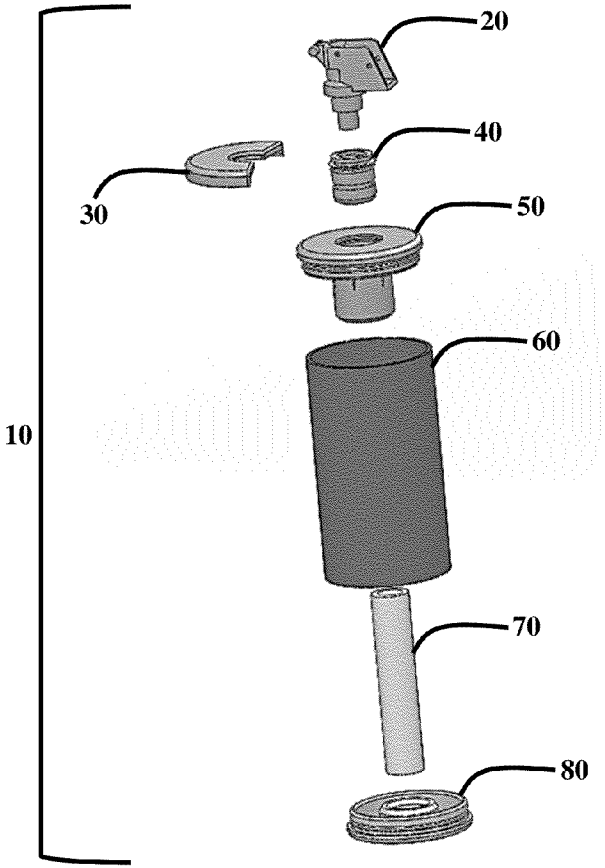
FIG. 1A illustrates a perspective exploded view of a grenade according to an embodiment herein.
Figure 2:
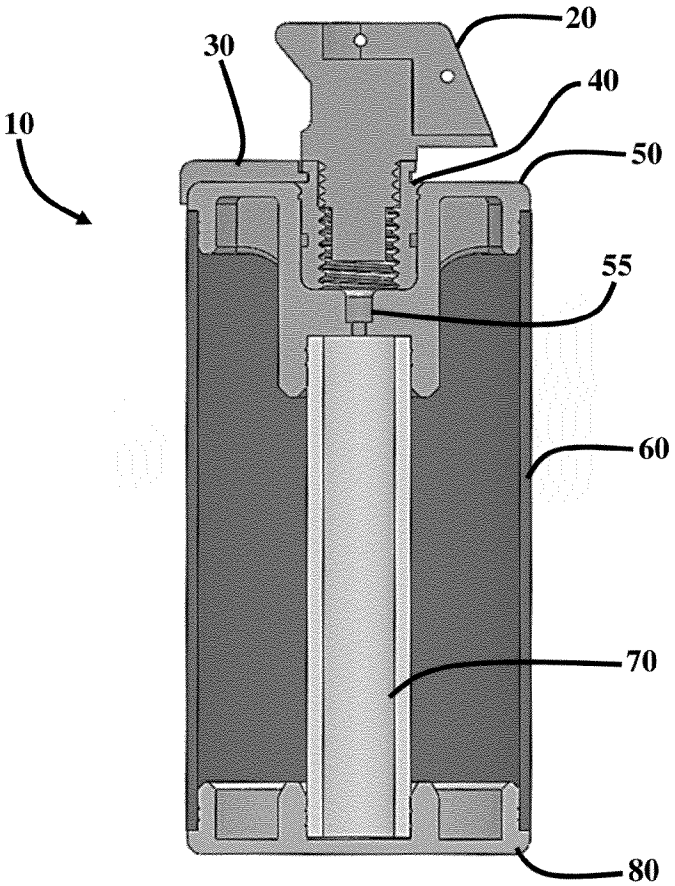
FIG. 2 illustrates a front sectional view of the assembled grenade of FIGS. 1A and 1B according to an embodiment herein
Figure 3:
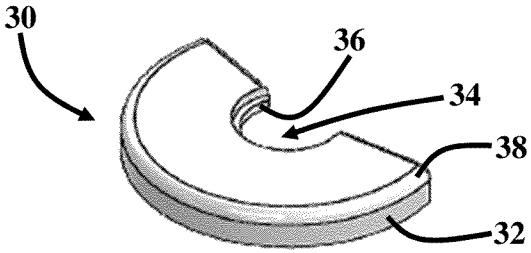
FIG. 3 illustrates a perspective view of the drag adapter of FIGS. 1A through 2 according to an embodiment herein.

FIG. 3, with reference to FIGS. 1A through 2, illustrates a perspective view of the drag adapter 30 according to an embodiment herein. The drag adapter 30 is generally configured in a semicircular configuration, although other configurations are possible in accordance with the embodiments herein. The drag adapter 30 comprises a body portion 32 comprising a beveled upper edge 38 and a cut-out groove 34. The body portion 32 further comprises an inner threaded edge 36.

Figure 4:
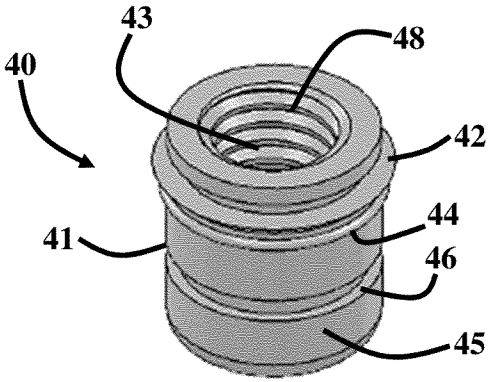
FIG. 4 illustrates a perspective view of the fuze bushing of FIGS. 1A through 2 according to an embodiment herein.

FIG. 4, with reference to FIGS. 1A through 2, illustrates a perspective view of the fuze bushing 40 according to an embodiment herein. The fuze bushing 40 comprises a substantially cylindrical body portion 41 comprising a hollow inner portion 43 and a recessed portion 46 etched on the outer surface 45 of the body portion 41. The fuze bushing 40 further comprises a collar portion 42 adjacent to an indent feature 44. The inner portion 43 is configured with threads 48.

Figure 5:
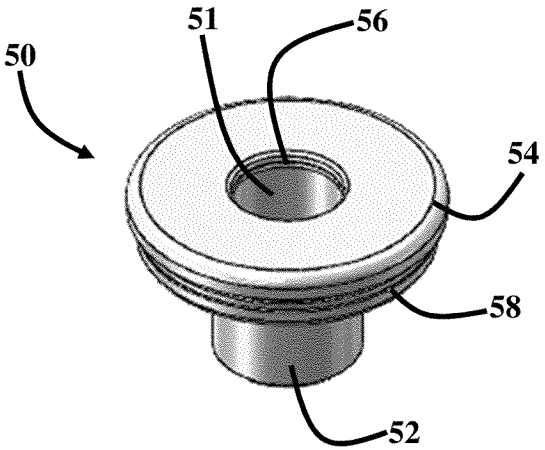
FIG. 5 illustrates a perspective view of the top plate of FIGS. 1A through 2 according to an embodiment herein.

FIG. 5, with reference to FIGS. 1A through 2, illustrates a perspective view of the top plate 50 according to an embodiment herein. The top plate 50 comprises a substantially cylindrical body 52 comprising an upper plate 54 having a threaded outer edge 58 and a partially threaded inner edge 56. The body 52 and upper plate 54 comprise a hollow inner portion 51.

Figure 6:
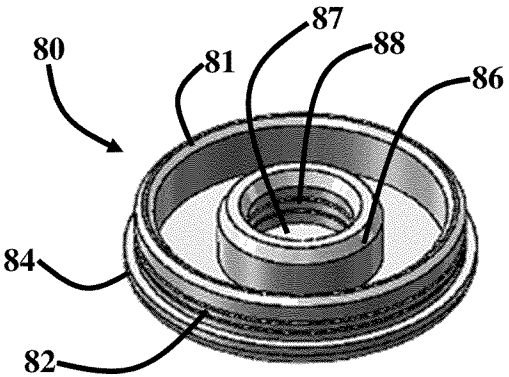
FIG. 6 illustrates a perspective view of the bottom plate of FIGS. 1A through 2 according to an embodiment herein.

FIG. 6, with reference to FIGS. 1A through 2, illustrates a perspective view of the bottom plate 80 according to an embodiment herein. The bottom plate 80 comprises an outer wall 81 comprising a threaded outer edge 82. The bottom plate 80 further includes an inner wall 86 spaced apart from the outer wall 81, wherein the inner wall 86 comprises a hollow inner portion 87 and is configured with threads 88 configured on the inner portion 87. An end cap 84 seals the bottom plate 80 such that the bottom portion 85 (shown in FIG. 1B) of the bottom plate 80 is closed.

When the fuze 20 functions, hot gases and sparks are released between the fuze bushing 40 and the top plate 50. The pressure build-up overcomes the snap-in feature (e.g., of the fuse bushing 40) causing the fuze 20 and fuze bushing 40 to be ejected. An asymmetric drag adapter 30 attached to the fuze bushing 40 serves to dissipate kinetic energy to further reduce fragmentation hazards.

The sparks and hot gases released also serve to ignite a delay column 55 pressed into the top plate 50. After approximately one second, the delay column 55 then activates a primer (not shown) that then initiates the central burster tube 70. This delay allows time for the fuze 20 to travel sufficiently far enough from the grenade 10 so that it is not accelerated by the central burster tube 70.

This improved design of the M-106 uses the same cardboard body 60 and burster tube 70 as the conventional designs. The bolts and the aluminum top and bottom plates of the conventional designs are replaced by injection molded Santoprene® thermoplastic elastomer (TPE) parts, according to one embodiment. Santoprene® is an elastomer that is a mixture of in-situ cross linking of ethylene propylene diene monomer (M-class) (IEPDM) rubber and polypropylene. Santopren® is available in hardness grades 35 Shore A to 60 Shore D. The top and bottom plates 50, 80 are epoxied to the cardboard body 60 and burster tube 70 eliminating the necessity for bolts in the embodiments herein.

Accordingly, the embodiments herein provide a technique for the reduction of the fragmentation hazard produced if the fuze 20 shears. There is no fragmentation hazard from broken bolts since they are no longer required according to the embodiments herein, which is a departure from the conventional solutions and designs. The lack of bolts and replacement of aluminum parts with Santoprene also reduce costs and reduces assembly time. Because the bolts and end plates of the embodiments herein are attached prior to loading, powder cannot be compressed; it can only be poured in and left loose. The embodiments herein provide more fill options for bispectral fill candidates currently being explored. Alternative embodiments include modifying the materials of construction to include alternate durometers of Santoprene® or another elastomeric material. Material changes of this manner would still serve to minimize the potential hazards from fragments.

Preliminary testing was completed to determine the energy of fragments expelled from the grenade 10. Fragment velocity was determined in a test chamber (not shown) using velocities recorded by high speed video. The pop off fuze velocities were determined to be on average 34 ft/s for the fuze 20 with drag adapter 30 and 39 ft/s for the fuze 20 only. The maximum kinetic energy was calculated to be 2.5 and 2.9 ft-lb respectively. The average maximum kinetic energy of the top plate 50 of the grenade 10 after functioning of the central burster tube 70 was calculated to be 33 ft-lb and 13.2 ft-lb for the bottom plate 80. The Range Commanders Council Range Safety Group, Supplement to Standard 321-02. "Common Risk Criteria for National Test Ranges—Inert Debris" indicates that an impact kinetic energy of 58 ft-lbf for a standing person is considered a hazardous fragment. All calculated impact energies tested are below this value thereby validating the usefulness of the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A grenade comprising:

a fuze;

a fuze bushing operatively connected to said fuze;

a top plate operatively connected to said fuze bushing, wherein said fuze bushing is snap fit into said top plate;

a drag adapter partially surrounding and attached to said fuze bushing and adjacent to said top plate;

a burster tube operatively connected to said top plate;

a bottom plate operatively connected to said burster tube; and a housing body operatively connected to said top plate and said bottom plate and housing said burster tube.

2. The grenade of claim 1, wherein said fuze is configured to initiate causing gases and sparks to be released between said fuze bushing and said top plate.

3. The grenade of claim 2, wherein said gases and sparks increases a pressure between said top plate and said fuze bushing to overcome the snap fit between the fuze bushing and the top plate and causing said fuze and said fuze bushing to be ejected from said housing body.

4. The grenade of claim 3, wherein said drag adapter dissipates kinetic energy of said fuze and fuze bushing upon said fuze and said fuze bushing being ejected from said housing body.

5. The grenade of claim 2, further comprising a delay column pressed into said top plate.

6. The grenade of claim 5, wherein said gases and sparks ignite said delay column.

7. The grenade of claim 6, wherein said delay column activates a primer after a predetermined delay of approximately one second, wherein said primer then initiates said burster tube after said fuze and fuze bushing have traveled far enough from the grenade body so that said fuze is not accelerated by initiation of said central burster tube.

8. The grenade of claim 1, wherein said top plate and said bottom plate are epoxied to said housing body and said burster tube.

9. The grenade of claim 1, wherein said top and bottom plates are thermoplastic elastomer, and said housing body and burster tube are cardboard.

10. An incendiary device comprising:

a fuze;

a fuze bushing operatively connected to said fuze;

a top plate snap fit to said fuze bushing;

a delay column pressed into said top plate;

a drag adapter partially surrounding and attached to said fuze bushing and contacting a top surface of said top plate;

a burster tube operatively connected to said top plate;

a bottom plate operatively connected to said burster tube; and a housing body attached to said top plate and said bottom plate and surrounding said burster tube.

11. The incendiary device of claim 10, wherein said fuze is configured to initiate causing gases and sparks to be released between said fuze bushing and said top plate.

12. The incendiary device of claim 11, wherein said gases and sparks increases a pressure between said top plate and said fuze bushing to overcome the snap fit between the fuze bushing and the top plate and causing said fuze and said fuze bushing to be ejected from said housing body.

13. The incendiary device of claim 12, wherein said drag adapter dissipates kinetic energy of said fuze and said fuze bushing upon said fuze and said fuze bushing being ejected from said housing body.

14. The incendiary device of claim 11, wherein said gases and sparks ignite said delay column.

15. The incendiary device of claim 14, wherein said delay column activates a primer after a predetermined delay of approximately one second, wherein said primer then initiates said burster tube after said fuze has traveled far enough from said housing body so that said fuze is not accelerated by initiation of said burster tube.

16. The incendiary device of claim 10, wherein said top plate and said bottom plate are epoxied to said housing body and said burster tube.

17. The incendiary device of claim 10, wherein said top and bottom plates are thermoplastic elastomer, and said housing body and burster tube are cardboard.

18. An incendiary device comprising:

a fuze;

a fuze bushing operatively connected to said fuze;

a top plate snap fit to said fuze bushing;

a delay column pressed into said top plate;

a drag adapter partially surrounding and attached to said fuze bushing and contacting a top surface of said top plate;

a burster tube operatively connected to said top plate;

a bottom plate operatively connected to said burster tube; and a housing body attached to said top plate and said bottom plate and surrounding said burster tube, wherein said top plate and said bottom plate are epoxied to said housing body and said burster tube, wherein said fuze is configured to initiate causing gases and sparks to be released between said fuze bushing and said top plate, wherein said gases and sparks increases a pressure between said fuze and said top plate causing said fuze and said fuze bushing to be ejected from said housing body, wherein said drag adapter dissipates kinetic energy of said fuze and said fuze bushing upon said fuze and said fuze bushing being ejected from said housing body, wherein said gases and sparks ignite said delay column, wherein said delay column activates a primer alter a predetermined delay, wherein said primer then initiates said burster tube, and wherein said predetermined delay permits said fuze to travel far enough from said housing body so that said fuze is not accelerated by initiation said burster tube.

19. The incendiary device of claim 18, wherein said top and bottom plates are thermoplastic elastomer, and said housing body and burster tube are cardboard.

* * * * *